US007155841B2

(12) United States Patent
Livingston

(10) Patent No.: US 7,155,841 B2
(45) Date of Patent: Jan. 2, 2007

(54) ROTARY IMPINGING STREAM DRYER

(75) Inventor: Andrew Livingston, Independence, KS (US)

(73) Assignee: Earth Care Products, Inc., Independence, KS (US)

( * ) Notice: Subject to any disclaimer, the term of this patent is extended or adjusted under 35 U.S.C. 154(b) by 82 days.

(21) Appl. No.: 11/091,640

(22) Filed: Mar. 28, 2005

(65) Prior Publication Data

US 2006/0213075 A1 Sep. 28, 2006

(51) Int. Cl.
*F26B 11/02* (2006.01)

(52) U.S. Cl. ..... 34/136; 34/137; 34/138

(58) Field of Classification Search ..... 34/125–138; 366/229, 57; 432/118
See application file for complete search history.

(56) References Cited

U.S. PATENT DOCUMENTS

| | | | | |
|---|---|---|---|---|
| 1,456,392 | A | 5/1923 | Marshall | |
| 2,316,459 | A | 4/1943 | Schmidt et al. | |
| 2,470,315 | A | 5/1949 | McGehee | |
| 3,571,944 | A | 3/1971 | Duhem | 34/57 |
| 3,780,447 | A | 12/1973 | Fales | 34/136 |
| 4,114,289 | A * | 9/1978 | Boulet | 34/173 |
| 4,177,575 | A * | 12/1979 | Brooks | 34/392 |
| 4,427,376 | A * | 1/1984 | Etnyre et al. | 432/105 |
| 4,633,595 | A | 1/1987 | van den Broek | 34/108 |
| 4,769,923 | A | 9/1988 | Chang | 34/57 |
| 4,802,288 | A | 2/1989 | Shinn et al. | 34/136 |
| 4,945,657 | A | 8/1990 | Shinn et al. | 34/128 |
| 5,285,581 | A | 2/1994 | Walker | 34/28 |
| 6,249,988 | B1 * | 6/2001 | Duske et al. | 34/62 |

FOREIGN PATENT DOCUMENTS

| | | |
|---|---|---|
| DE | 1812954 | 12/1968 |
| DE | 234481 | 2/1985 |
| GB | 1581542 | 6/1976 |
| SU | 1099197 | 1/1983 |
| SU | 1196638 | 7/1984 |

* cited by examiner

*Primary Examiner*—S Gravini
(74) *Attorney, Agent, or Firm*—Hovey Williams LLP

(57) ABSTRACT

An improved rotary shell or drum dryer (10) is provided having an elongated, horizontally disposed, axially rotatable shell (12) with product and air inlets (14, 18) and an outlet (16) at opposite ends of the shell. Internally, the dryer (10) includes axially spaced apart first and second drying sections (26, 28) each having a turbulator (30, 32) and a downstream serpentine flow section (34, 36). The turbulators (30, 32) are designed to divert portions of a product/airstream in different directions respectively to achieve the intense mixing similar to that obtained in an impingement dryer.

18 Claims, 4 Drawing Sheets

ROTARY IMPINGING STREAM DRYER

BACKGROUND OF THE INVENTION

1. Field of the Invention

The present invention is broadly concerned with improved rotary dryers which exhibit extremely high drying efficiency and are constructed so as to achieve a measure of impingement drying. More particularly, the invention is concerned with such dryers, as well as a gas turbulator design used therein and a method of drying, wherein the dryer includes first and second drying sections within a rotatable shell or drum, with each such section having a flow-diverting turbulator and a downstream serpentine flow section.

2. Description of the Prior Art

The drying of wood or agricultural particulates in a multi-stage dryer is dependent upon a large number of factors, e.g. the type of product to be dried, the initial moisture content thereof, particle geometry, variable ambient conditions, dryer configuration and fuels being employed.

In general, however, the drying process involves several distinct phases or stages. That is to say, most hygroscopic materials exhibit several distinct drying rate periods as they pass through a multi-pass dryer. Initial drying is accompanied by a warming of the material and its attendant moisture. The drying rate increases during this initial period, while the moisture content drops to a value which signals the beginning of a constant rate period of drying. During the constant rate period moisture is evaporated from the surface of product particles at a steady rate until the surfaces are no longer entirely wet. Thereafter, a falling-off period obtains where the drying rate decreases because of the increasing difficulty of moving internal product moisture to the particle surfaces where it can be taken up and moved away. Finally, the product moisture is reduced to a point where an equilibrium is established with the surrounding atmosphere.

Conventional three-pass dryers include an elongated horizontal, axially rotatable body having an outer drum and a series of concentric smaller diameter drums within the outer drum. The drums are in communication with each other and define a serpentine flow path within the dryer. Such dryers are provided with a product inlet oriented for directing initially wet product and hot drying air into the innermost, smallest diameter drum, whereupon the product is conveyed via induced draft current through the outer drum until it reaches a passageway defined by the outer drum and the next inboard drum. At this point the product is in its final fried condition and is delivered for further handling or collection. Thus, conventional three pass cylindrical dryers utilize comparatively high air velocities and temperature conditions in the innermost drum (first pass) where the incoming products are the heaviest and the wettest. Lower air velocities and lower temperatures obtain in the intermediate drum (second pass), and even lower velocities and temperatures exist in the outer drum (third pass). In practice, however, the relatively high air current velocity conditions in the first pass of a conventional dryer cause the wet product particles to be quickly driven away from the heat source, and there is consequently a reduced opportunity for adequate heat transfer and evaporation. In subsequent passes with lower air current velocities, the particles may settle out because the prevailing air current velocities fall below the saltation velocity of the product (i.e. the minimum air current velocity needed to pick up and convey product at a given moisture level). Thus, plugging of the dryer may occur, particularly at high product flow rates, and at best the product only moves at a rate determined by the forward velocity of the slowest moving (largest) particles. The result is that the flow rate is decreased and this inevitably has an adverse effect on drying efficiency.

U.S. Pat. No. 1,456,932 illustrates a dryer wherein vanes are located upstream of cylindrical drying areas along the length of the drum. None of these drying zones provide any reverse-flow serpentine arrangement. U.S. Pat. No. 3,571,944 provides an essentially conventional multiple-pass drum dryer but does not make use of any upstream flow diverting turbulator structure. Other references of general interest include: U.S. Pat. Nos. 5,285,581; 4,769,923; 4,633,595; 3,780,447; 2,470,315; 2,316,459; 4,802,288; and 4,945,657, and foreign patents DD 234,481; SU 1,196,638; SU 1,099,197; GB 1,581,542; and DE 1,812,954.

So-called impingement dryers have also been provided in the past. These dryers are characterized by design which directs incoming product to be dried into essentially direct intersection with a hot air drying stream. This type of dryer is very efficient, but heretofore the concept has not been usable in the context of rotary drum dryers.

SUMMARY OF THE INVENTION

The present invention overcomes the problems outlined above and provides an enhances efficiency rotary dryer generally including an elongated, generally horizontally disposed, axially rotatable shell or drum configured for passage of drying air therethrough, with an inlet for initially moist product to be dried adjacent one end of the shell and an outlet for dried product adjacent the other end of the shell. The dryer also has first and second drying sections located within the shell in axially spaced relationship to each other and between the inlet and the outlet. Each of the first and second drying sections includes an upstream turbulator and a downstream serpentine flow section. The turbulator is operable to mix and divert air and product during passage of the air and product to be dried therethrough, whereas the serpentine flow section includes wall structure for directing the air and product from the turbulator along an elongated serpentine flow path.

The preferred turbulator structure used in the first and second drying sections preferably comprises a generally circular frame having a gas inlet face and an opposed gas outlet face and including an inner annular wall and an outer annular wall. A plurality of elongated mixing vanes are located within the inner annular wall, at least some of the vanes oriented for diverting gas during passage thereof past the vanes in a first direction. Also, a number of elongated mixing plates are located between the inner and outer walls and in circumferentially spaced relationship to each other; at least certain of these plates are oriented for diverting of gas during passage thereof past the plates in a second direction different than the first direction. Advantageously, the vanes and plates are respectively of oppositely facing, concavo-convex design.

DETAILED DESCRIPTION OF THE PREFERRED EMBODIMENT

Figure 1:
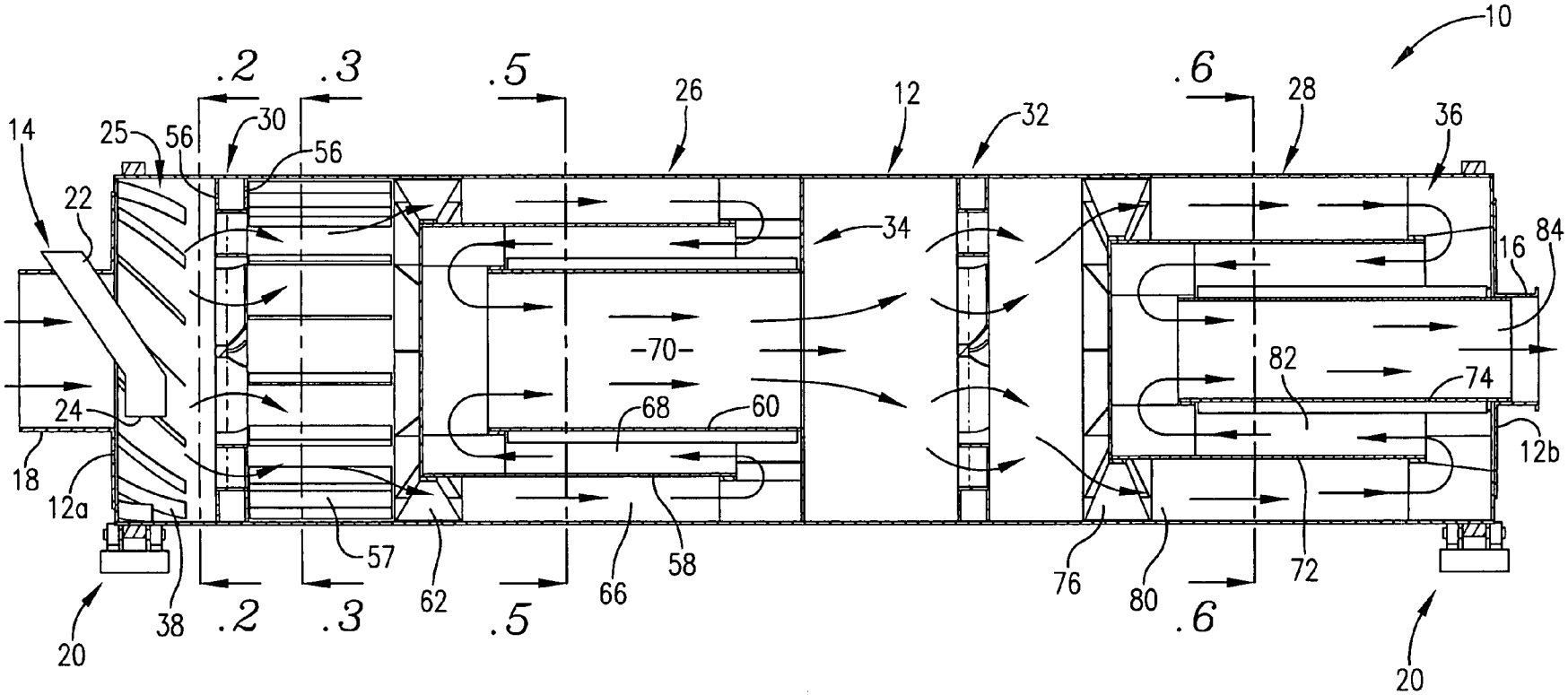
FIG. 1 is a vertical sectional view of a preferred rotary dryer in accordance with the invention, depicting the turbulators and associated serpentine flow sections.

Turning now to the drawings, and particularly FIG. 1, a rotary drum horizontal dryer 10 is illustrated. The dryer 10 includes an elongated, circular in cross section, axially rotatable dryer shell 12 presenting an initially wet product inlet 14 and a dried product outlet 16 at opposite ends of the shell 12. The shell 12 is also configured for passage of drying air through a hot air inlet 18 in order to create a combined air and wet product stream passing from the inlets 14 and 18 and ultimately out the outlet 16. Although not shown, those skilled in the art will appreciate that the dryer 10 is normally equipped with a conventional burner and feeder for respectively supplying the hot air to inlet 18 and initially wet product to inlet 14. Additionally, a downstream cyclone separator (also not shown) may be provided for separating the dried product and air passing from outlet 16. The dryer 10 can be operated using either forced and/or induced draft air.

In more detail, it will be noted that the shell 12 has annular end walls 12*a* and 12*b* and is supported on conventional endmost trunnion assemblies 20 which permit powered axial rotation of the shell via a motor and drive (not shown). The inlet 14 is in the form of a square tubular conduit 22 which extends downwardly from the feeder and terminates at an open bottom end 24. The inlet 18 comprises a tubular wall connected to annular end wall 12*a* and operably coupled with the upstream burner and communicating with the interior of shell 12.

Internally, the shell 12 has an inlet vane assembly 25 as well as first and second drying sections 26 and 28 located in axially spaced relationship within the shell 12 between inlets 14, 18 and outlet 16. Each of the sections 26 and 28 includes an upstream turbulator 30, 32 and a downstream serpentine flow section 34 and 36.

The inlet vane section 25 comprises a plurality of arcuate, circumferentially spaced apart, flow-directing vanes 38 welded or otherwise affixed to the inner surface of shell 12 adjacent end wall 12*a*. The purpose of the vanes 38 is to assist in the creation of an initially wet product and drying airstream which is then passed through the shell 12.

Figure 3:
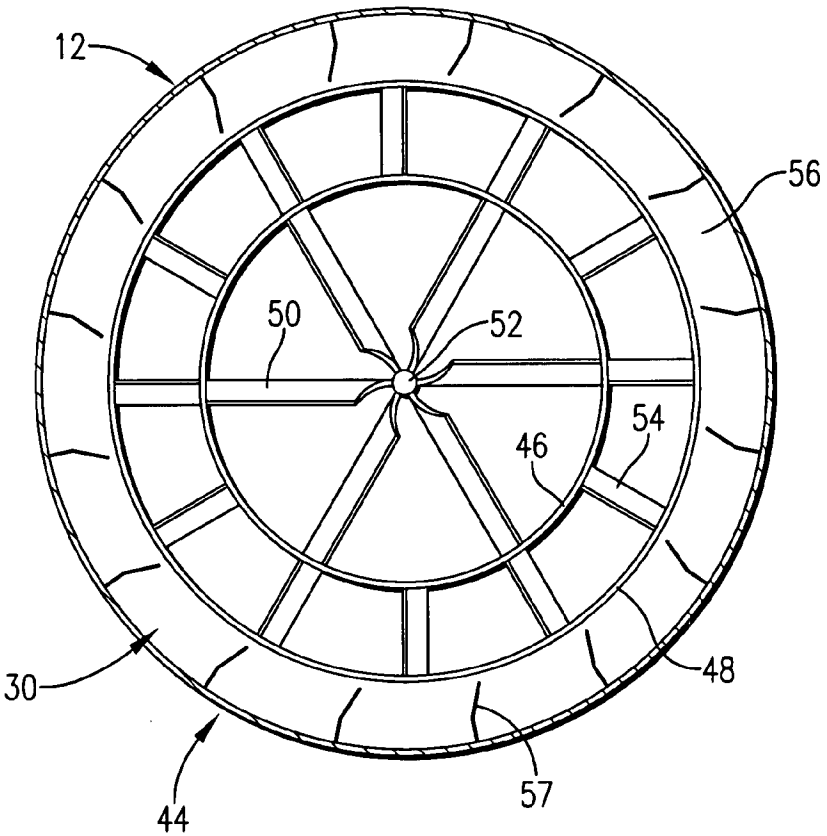
FIG. 3 is a vertical sectional view taken along line 3—3 of FIG. 1 and depicting the construction of the initial turbulator.
Figure 2:
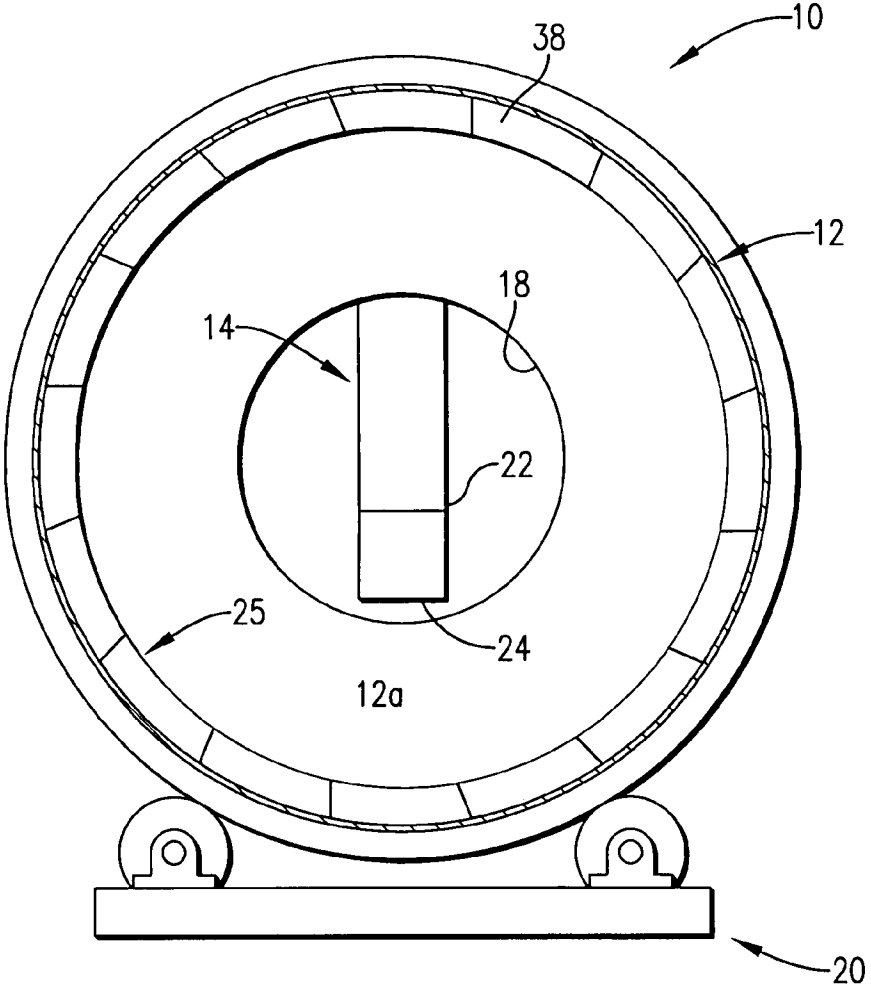
FIG. 2 is a vertical sectional view taken along line 2—2 of FIG. 1 and illustrating the construction of the dryer inlet.
Figure 4:
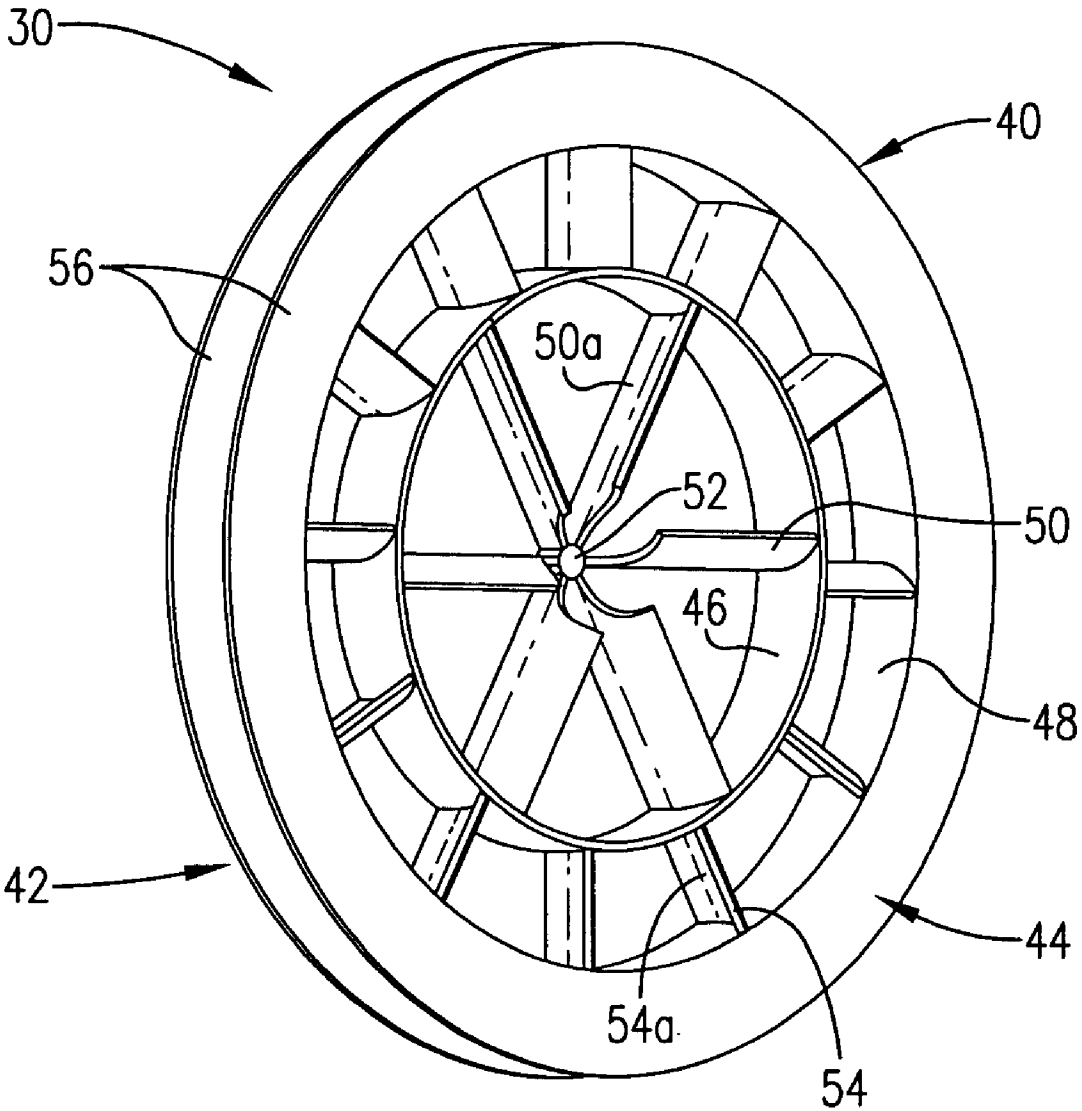
FIG. 4 is a perspective view of the preferred turbulator structure used in the dryers of the invention.
Figure 6:
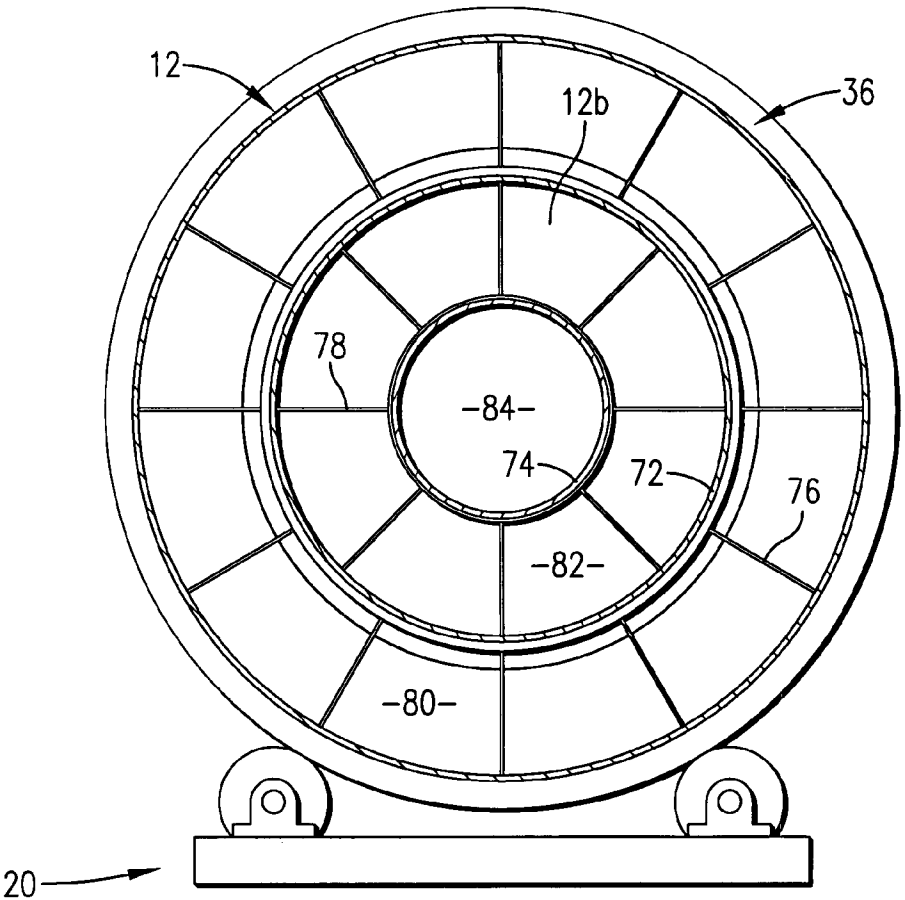
FIG. 6 is a vertical sectional view taken along line 6—6 of FIG. 1 and showing the construction of the second serpentine flow section.
Figure 5:
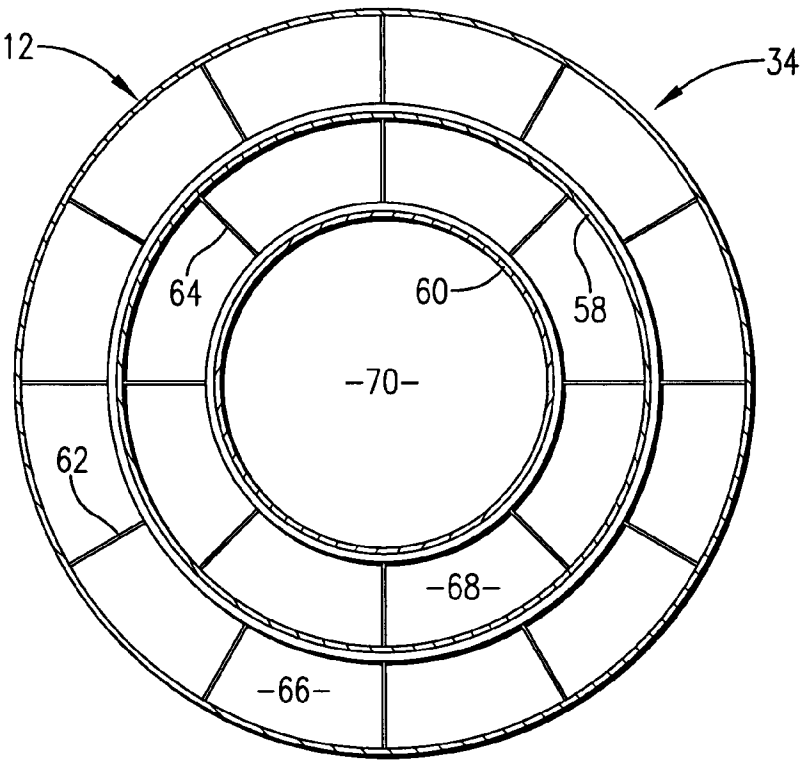
FIG. 5 is a vertical sectional view taken along line 5—5 of FIG. 1 and showing the construction of the first serpentine flow section.

As noted, each of the sections 26,28 has a turbulator 30 or 32. Preferably, the turbulators are identically constructed. Attention is directed to FIGS. 3 and 4 which illustrate the construction of the preferred turbulator. In detail, the turbulator 30 (and thus the turbulator 32) includes a generally circular frame 40 presenting an inlet face 42 and an opposed outlet face 44, and has an inner annular wall 46 and an outer annular wall 48 which are substantially coaxially mounted. A plurality of radially extending, concavo-convex vanes 50 are located within inner annular wall 46 and extend between and are connected to a central hub 52 and the inner surface of wall 46. Additionally, a number of elongated, circumferentially spaced apart concavo-convex mixing plates 54 are located between and are connected to the outer surface of wall 46 and the inner surface of wall 48. It will be observed that the concave faces 50*a* of the vanes 50 face oppositely as compared with the concave faces 54*a* of the plates 54. The turbulator 30 is completed by provision of a pair of outermost imperforate annular walls 56 which extend from outer annular wall 48 for connection to the inner surface of shell 12. As best seen in FIGS. 1 and 3, a plurality of gusset-type straight vanes 57 are secured to the inner face of shell 12 between the outlet face 44 of turbulator 30 and the inlet of first serpentine flow section 34.

The first serpentine flow section 34 is made up of a pair of substantially coaxial elongated annular walls 58 and 60 which are supported by first and second elongated support plates 62 and 64. The plates 62 are secured to the inner face of shell 12 and the outer face of wall 58. Similarly, the second support plates 64 are secured to the inner face of wall 58 and the outer face of wall 60. Hence, the section 34 defines a total of three annular, substantially concentric flow paths 66, 68 and 70. The path 66 is between shell 12 and wall 58 and defines the inlet for the product/airstream. The path 68 is between the walls 58 and 60 and defines an intermediate flow path. Finally, the wall 60 defines the path 70 which the product/airstream outlet for the section 34. It will also be seen that the product/airstream passes in a forward direction along path 66, in a reverse direction along path 68, and again in a forward direction along path 70.

As explained previously, the turbulator 32 downstream of section 34 is of the same construction as turbulator 30; accordingly, no further description of the turbulator 32 is required.

The second serpentine flow section 36 is very similar to the section 34, and is made up of elongated, substantially coaxially oriented outer and inner annular walls 72 and 74, as well as respective support plates 76 and 78. The plates 76 are secured to the inner face of shell 12 and the outer face of wall 72, whereas the plates 78 are connected to the inner face of wall 72 and the outer face of wall 74. Finally, the shell 12 and walls 72, 74 cooperatively define an outermost inlet flow path 80, an inner reverse direction flow path 82, and an outlet flow path 84 communicating with shell outlet 16. As before, the section 36 is designed so that the product/airstream moves forwardly along path 80, in a reverse direction along path 82, and finally in a forward direction along path 84. While the section 34 and 36 are very similar in construction, it will be noted that the diameter of wall 74 is smaller than the diameter of wall 60 which thereby increases the velocity of the product/airstream along flow path 84, as compared with that along path 70.

In operation, initially wet product is directed through inlet 14 while hot drying air is directed through inlet 18. A product/airstream is formed within shell 12, primarily at the region of vanes 25. Thereafter, this stream is directed through the first and second drying sections 26, 28 for ultimate passage out outlet 16. During passage of the stream through turbulators 30, 32, intense mixing is obtained owing to the presence of the vanes 50 and plates 54. Specifically, the turbulators cause the stream to be mixed by diverting respective stream portions in different directions, principally because of the orientation and concavo-convex nature of the vanes 50 and plates 54. This achieves a drying operation akin to that of a conventional impingement dryer in the context of a rotary dryer. After passing the turbulators 30, 32, the stream is directed along the serpentine flow path in the sections 34, 36. This increases the residence time of the product within the dryer and enhances the drying efficiency thereof.

I claim:

1. A gas turbulator comprising;

a generally circular frame having a gas inlet face and an opposed gas outlet face and including an inner annular wall and an outer annular wall;

a plurality of elongated, stationary mixing vanes located within said inner annular wall, at least some of said vanes oriented for diverting gas during passage thereof past the vanes in a first direction; and a number of elongated mixing plates located between said inner and outer walls and in circumferentially spaced relationship to each other, at least certain of said plates oriented for diverting of gas during passage thereof past the plates in a second direction different than said first direction.

2. The turbulator of claim 1, said inner and outer annular walls being substantially coaxially aligned.

3. The turbulator of claim 1, said vanes extending in a substantially radial direction.

4. The turbulator of claim 1, said vanes being of concavo-convex configuration.

5. The turbulator of claim 1, said plates being substantially radially oriented and being of concavo-covex configuration.

6. The turbulator of claim 1, said vanes and said plates being of concavo-convex configuration, with the concave faces of the vanes being oppositely oriented relative to the concave faces of said plates.

7. The turbulator of claim 1, said frame including a pair of annular, substantially imperforate sidewalls located outboard of said outer annular wall.

8. A rotary dryer comprising:

an elongated, generally horizontally disposed, axially rotatable shell configured for passage of drying air therethrough;

an inlet for initially moist product to be dried adjacent one end of said shell;

an outlet for dried product adjacent the other end of said shell;

first and second drying sections located within said shell in axially spaced relationship to each other and between said inlet and said outlet, each of said first and second drying sections including an upstream turbulator and a downstream serpentine flow section, said turbulator operable to mix and divert air and product during passage of said air and product to be dried therethrough, said serpentine flow section including telescoped inner and outer wall structure for directing said air and product from said turbulator along an elongated serpentine flow path.

9. The dryer of claim 8, each of said turbulators comprising:

a generally circular frame having a gas inlet face and an opposed gas outlet face and including an inner annular wall and an outer annular wall;

a plurality of elongated mixing vanes located within said inner annular wall, at least some of said vanes oriented for diverting gas during passage thereof past the vanes in a first direction; and a number of elongated mixing plates located between said inner and outer walls and in circumferentially spaced relationship to each other, at least certain of said plates oriented for diverting of gas during passage thereof past the plates in a second direction different than said first direction.

10. The dryer of claim 9, said inner and outer annular walls being substantially coaxially aligned.

11. The dryer of claim 9, said vanes extending in a substantially radial direction.

12. The dryer of claim 9, said vanes being of concavo-convex configuration.

13. The dryer of claim 9, said plates being substantially radially oriented and being of concavo-covex configuration.

14. The dryer of claim 9, said vanes and said plates being of concavo-convex configuration, with the concave faces of the vanes being oppositely oriented relative to the concave faces of said plates.

15. The dryer of claim 9, said frame including a pair of annular, substantially imperforate sidewalls located outboard of said outer annular wall and extending toward said shell.

16. The dryer of claim 8, each of said serpentine flow sections including a pair of substantially coaxial inner and outer annular walls, there being an inlet between said outer annular wall and said shell, a first reverse flow path between said outer and inner annular walls, and a second reverse flow path defined by said inner annular wall.

17. The dryer of claim 16, the diameter of said inner annular wall of said first serpentine section being greater than the diameter of the inner annular wall of the second serpentine section.

18. A method of drying an initially wet product comprising the steps of:

forming an initially wet product and drying airstream and passing said stream into and through an elongated, generally horizontally oriented axially rotatable dryer shell having an initially wet product inlet, and a dried product outlet at opposite ends thereof; and during rotation of said shell, directing said stream through first and second axially spaced apart drying sections located between said inlet and said outlet during passage of the stream through said shell, during said direction of said stream through each of said drying sections, causing said stream to be initially mixed by diverting respective stream portions in different directions, and thereafter passing the stream along a downstream serpentine flow path.

* * * * *